US005271442A

United States Patent [19]

Carpenter et al.

[11] Patent Number: 5,271,442

[45] Date of Patent: Dec. 21, 1993

[54] KNIFE WITH CLAMP PACKAGE MOUNTING KNIFE

[75] Inventors: Charles T. Carpenter; Robert M. Bayly, both of Lake Oswego, Oreg.

[73] Assignee: Commercial Knife, Inc., Wilsonville, Oreg.

[21] Appl. No.: 19,586

[22] Filed: Feb. 19, 1993

[51] Int. Cl.[5] ..... B27G 13/04

[52] U.S. Cl. ..... 144/220; 83/698; 144/162 R; 144/218; 144/241; 241/92; 241/292.1; 241/298; 407/37; 407/40; 407/87; 407/9 S

[58] Field of Search ..... 83/698; 407/85, 87, 407/94, 95, 108, 37, 40, 41; 241/91, 92, 189.1, 292.1, 278, 298; 144/162 R, 172, 174, 176, 218, 219, 220, 224, 228, 229, 230, 225, 221, 231, 241

[56] References Cited

U.S. PATENT DOCUMENTS

| | | | |
|---|---|---|---|
| 3,777,793 | 12/1973 | Miller . | |
| 4,082,127 | 4/1978 | Miller | 144/220 |
| 4,444,233 | 4/1984 | Miller . | |
| 4,503,893 | 3/1985 | Demopoulos | 144/241 |
| 4,569,380 | 2/1986 | Arasmith | 144/241 |
| 4,784,337 | 11/1988 | Nettles et al. | 144/241 |
| 5,146,963 | 9/1992 | Carpenter et al. . | |

*Primary Examiner*—W. Donald Bray
*Attorney, Agent, or Firm*—Kolisch, Hartwell, Dickinson, McCormack & Heuser

[57] ABSTRACT

A log slabbing chipper with multiple knife structures distributed about the periphery of a power-driven rotor head. Each knife structure includes a holder, and a pair of knife mounting assemblies secured to the holder. Each knife mounting assembly mounts a double-edged replaceable knife.

9 Claims, 3 Drawing Sheets

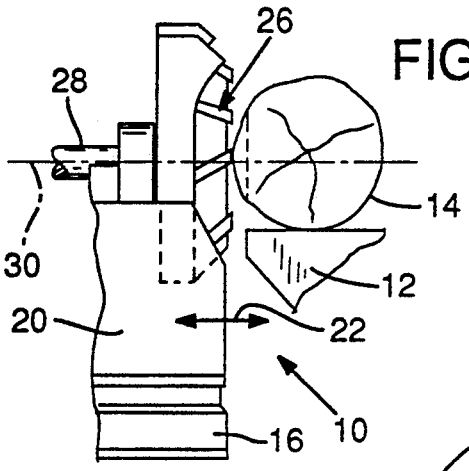
FIG. 1
FIG. 2
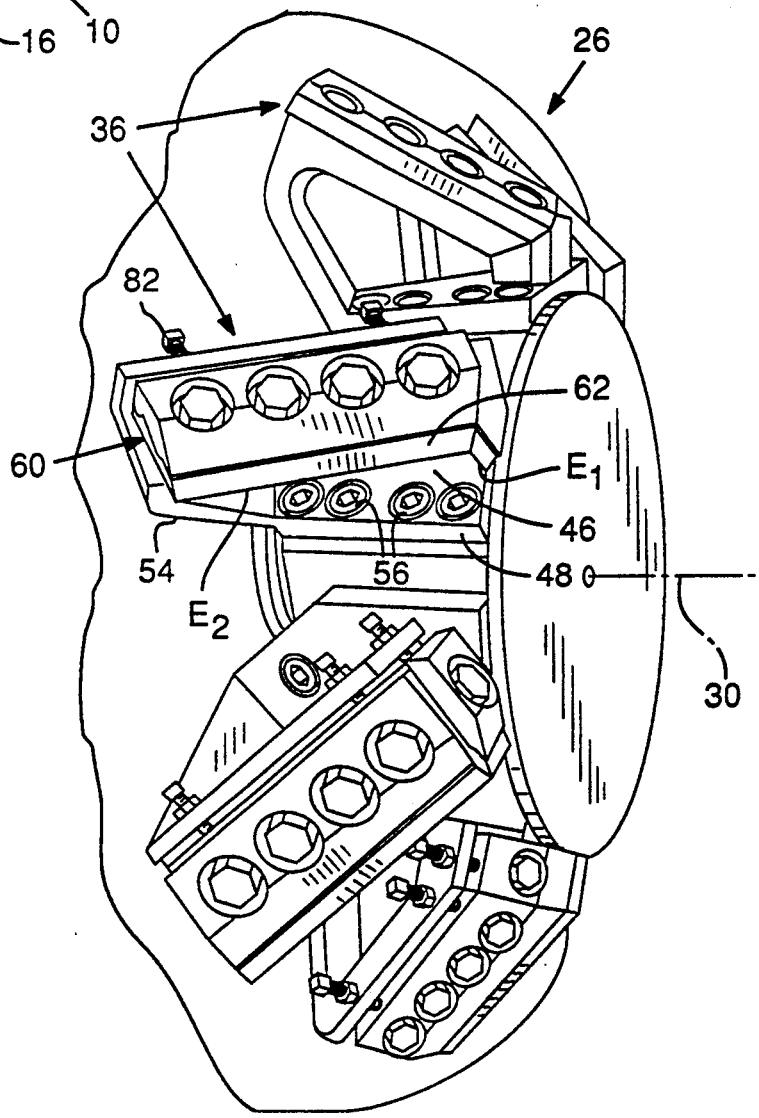

KNIFE WITH CLAMP PACKAGE MOUNTING KNIFE

BACKGROUND AND SUMMARY OF THE INVENTION

This invention relates to woodworking machines, such as a log slabbing chipper. The chipper includes a power-rotated head disposed to one side of a support for a log, and the head supports knife structures on its periphery which operate to chip off wood material on a log with relative movement of the power-driven head with respect to a log thereadjacent. In a chipper as just described, the knife structures on the chipper head are rotated against the side of the log to produce the chipping action. Each knife structure includes one edge portion (a chip cutting edge portion) moving in what might be thought of as a conical path, which functions to cut off chips as the structure is rotated and moved along the side of a log. Each knife structure further includes what is sometimes referred to as a planing edge portion, which moves in a plane and which smoothes or planes a flat surface on the log as the chips are cut off by the chip cutting edge portion.

In a woodworking machine of the type just described, obviously it is important that the knife cutting edge portions be sharp for efficient and accurate cutting of the wood. Additionally, accurate positioning of the knife or knives having the edge portions described is extremely important, if chips of uniform and optimum size are to be obtained.

A general object of the invention is to provide a novel form of knife structure for the rotating head of a woodworking machine, such as a chipper, which includes a pair of knives appropriately mounted to produce a chipping and a planing action as the structure is moved with rotation of the head.

More specifically, an object is to provide a novel knife structure featuring a pair of knives, where each of the knives is a double-edged knife, and the construction enables such a knife to be turned on itself with the replacing after dulling of one edge of the knife with the knife's opposite edge.

Another object is to provide an improved structure for supporting or mounting a knife in a woodworking machine, such as a log slabbing chipper, which enables a knife easily to be turned on itself for the purpose of replacing the edge that is performing the cutting, and further enables the entire knife to be replaced by another knife with minimal or no adjustments required to obtain proper positioning of the knife. With the construction contemplated, knife replacement is rapidly performed.

A further object is to provide novel knife structure for a woodworking machine, such as a log slabbing chipper, which features a pair of double-edged knives disposed end-to-end, and at an angle with respect to each other, with the position of these knives accurately determined. Additionally, the position of the knives is rapidly and accurately reproducible after turning the knives whereby the cutting edges are changed, or after replacing the knives with new knives.

With the construction contemplated, downtime necessitated for the sharpening and repositioning of knives as commonly experienced with prior known construction is sharply reduced.

BRIEF DESCRIPTION OF THE DRAWINGS

These and other objects and advantages are attained by the invention, which is described hereinbelow in conjunction with the accompanying drawings, wherein:

FIG. 1 illustrates in simplified form a log slabbing chipper as contemplated by the invention;

FIG. 2 is a perspective view of a rotor head in the chipper and multiple knife structures on the rotor head distributed about its periphery producing chipping and cutting of the wood as the rotor head revolves;

DETAILED DESCRIPTION OF A PREFERRED EMBODIMENT

Figure 3:
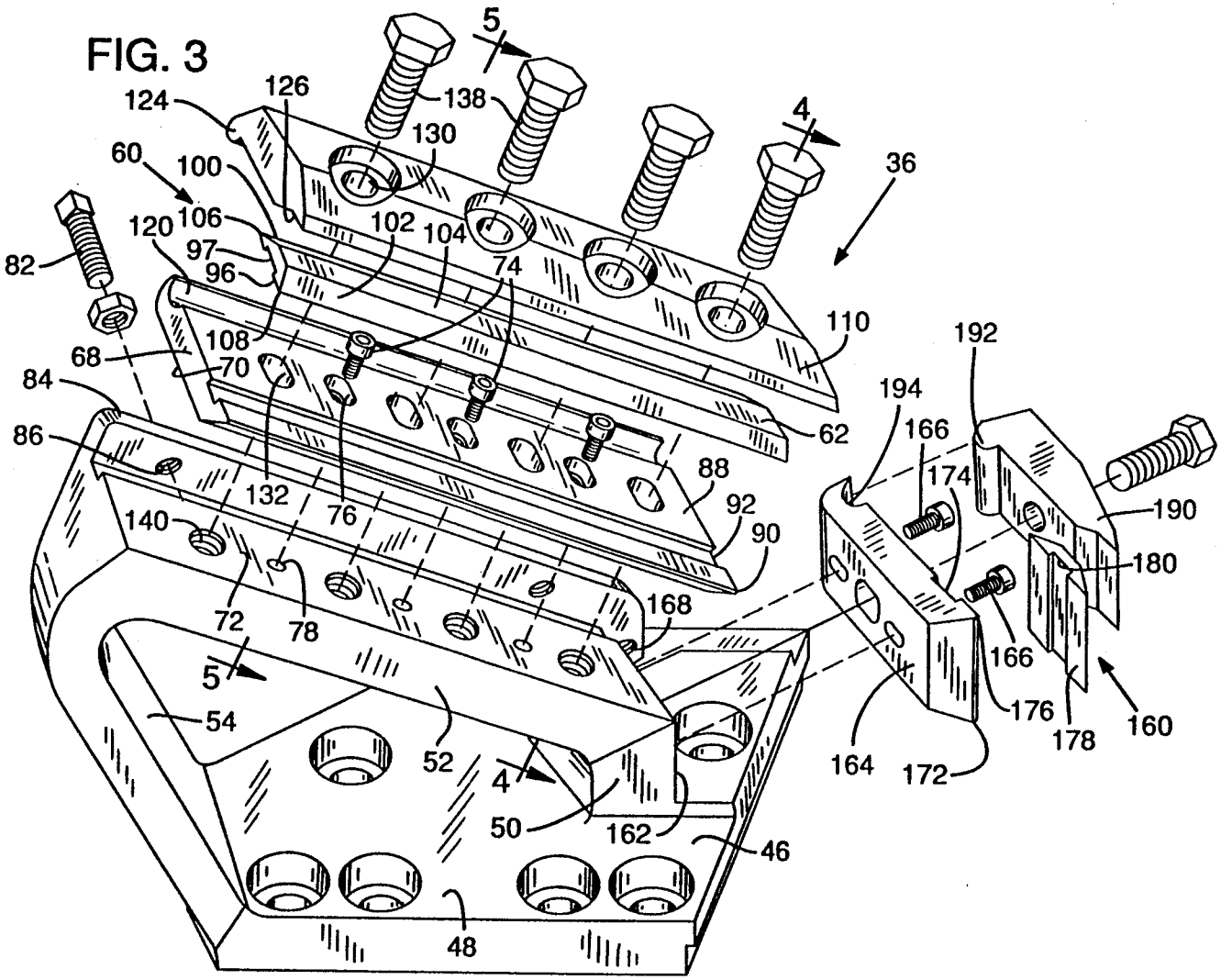
FIG. 3 is an exploded view of a knife structure including a holder and a pair of mounting assembles secured to the holder.
Figure 4:
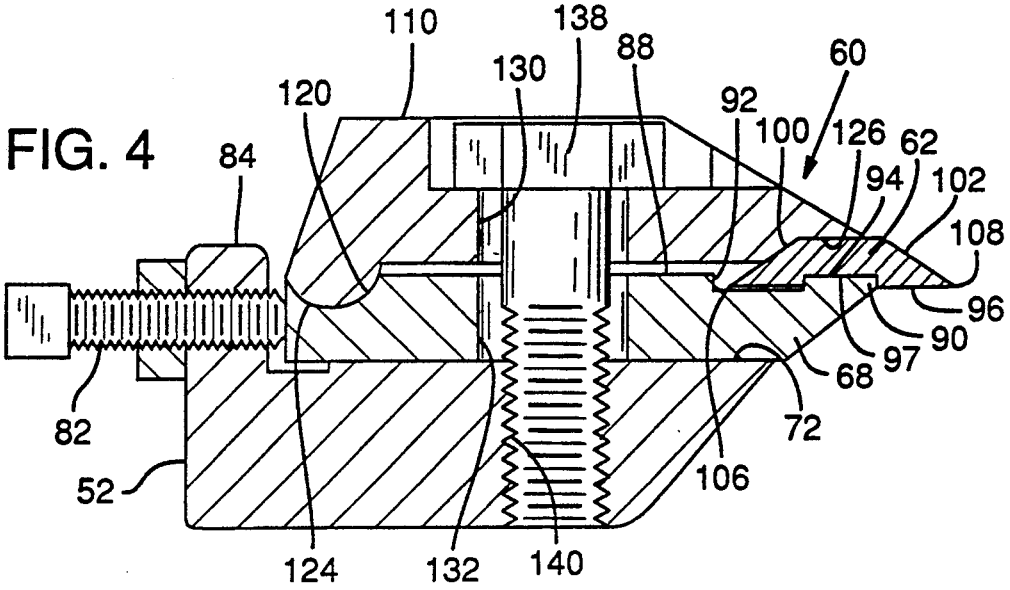
FIGS. 4 and 5 are cross-sectioned views, taken generally along the lines 4—4 and 5—5 in FIG. 3, further illustrating a mounting assembly and the knife which is mounted therein.
Figure 5:
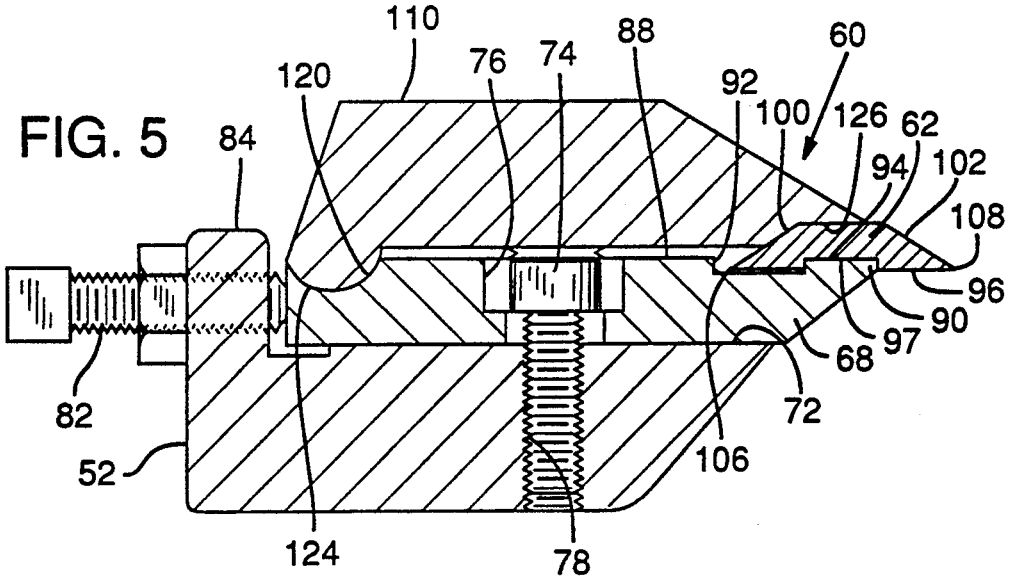

Referring now to the drawings, a log slabbing chipper or edger is illustrated in simplified form in FIG. 1 at 10. The chipper or woodworking machine includes a carriage 12 or log supporting means, which mounts a log 14, with the log and carriage being movable in a direction extending longitudinally of the log or toward and away from the viewer as the log and carriage are illustrated in FIG. 1.

Supported to one side of the carriage, on a frame 16 suitably secured to the ground, is a stand 20 mounted for sliding movement on the frame toward and away from the log, or in the direction indicated by the arrow 22 in FIG. 1.

Rotatably supported on stand 20 is a power-driven rotor head 26. The rotor head is rotated under power by a suitable means, such as belts or a motor connected to shaft 28. The rotor head rotates about axis 30.

Distributed about axis 30 on the rotor head are multiple knife structures given the reference number 36. Each of these knife structures, as will be described, mounts a pair of blades, presenting edge E1 disposed in a plane which is perpendicular to axis 30, and an edge E2, which is considerably longer than edge E1, disposed at an obtuse angle with respect to edge E1. With rotation of the rotor head, edge E1, which constitutes a planing edge, planes a smooth, flat surface on the log or workpiece. Edge E2, on the other hand, together with other edges in the rotor head like it, rotates on a conical surface, and is operable to cut chips from the workpiece or log.

Considering in more detail the construction of a knife structure 36, each includes what is referred to herein as a holder 46. Holder 46 has a base 48, an upstanding portion 50, a backing portion 52 joined to and extending out at an angle from the upstanding portion, and a bracing portion 54.

The holder is secured to the rotor head with fasteners shown at 56 extending through the base and into the framework of the rotor head.

Backing portion 52 provides support for a knife mounting assembly 60 mounting a double-edged knife 62.

Further explaining, a knife support or support element is shown at 68. Side 70 of this knife support, designated its outer side, is essentially flat, and rests while slidably supported on a flat surface 72 presented upwardly by backing portion 52 in the holder.

The knife support is secured to the holder independently of other parts in the knife assembly. More specifically, this attachment is by screw fasteners 74 extending downwardly through slots 76 in the knife support and into threaded bores 78 of the knife holder.

Determining an established position of the knife support on the holder are abutments screws 82. A raised shoulder 84 extends a substantial part of the length of backing portion 52, and screws 82 extend through threaded bores 86 in this shoulder. Adjustment of these screws produces adjustment in the defined position for the knife support. The knife support is securely held in its defined position by tightening of screws or fasteners 74.

The knife support has an upper surface 88. Extending along the knife support adjacent its forward edge 90 is a channel 92, with a shallow ridge 94 being defined between the channel and forward edge 90.

The knife support is supported on the holder with its forward edge 90 positioned beyond the holder and the rear portion of the knife support resting on the holder.

Knife 62 has a front face 96, and is symmetrical about a plane bisecting the knife and perpendicular to face 96. Indented inwardly from the front face is a shallow groove 97. Opposite front face 96 are back knife surfaces 100, 102, and clamping surface 104. Edges 106, 108 are on opposite sides of the knife.

The knife sits on the knife support with ridge 94 within shallow groove 97. This accurately positions the knife on the support. As so positioned, one of the knife's edges become located in an exposed position beyond forward edge 90 of the holder.

With use of the knife and on dulling of an exposed edge, the knife may be turned on itself, end-for-end, to locate its opposite edge in an exposed position. With dulling of both edges, the knife may be replaced with another knife having the same dimensions as the knife illustrated.

With all these changes there is substantially no change in the position of the sharp edge exposed for cutting.

Holding the knife firmly against the knife support is a knife clamp 110. The knife clamp has substantially the length of the knife support.

Extending along knife support 68, adjacent the rear edge of the knife support, is a groove 120 defined by a bottoming surface having an arcuate curvature viewing a cross-section of the groove. Knife clamp 110 has a rock shoulder 124 surfaced by an arcuately curving bottom surface. With the knife clamp in place against the knife support, shoulder 124 fits within groove 120 and with complementarily curved surfaces 122, 126 engaging each other.

The knife clamp has a forward knife clamp surface 126. With the clamp on the knife support and positioned by the rock shoulder, this clamp surface comes up against the back knife surface of the knife properly positioned on the knife support.

Openings of ovate cross section, shown at 130 in the knife clamp and at 132 in the knife support, loosely receive the shanks of fasteners 138 extending through the knife clamp and the knife support. The ends of the fastener shanks are threaded, and these threaded ends are received in threaded bores 140 provided in backing portion 52 of the holder. With these fasteners tightened the knife clamp is brought firmly against the knife lodged between the clamp and the knife support.

The exposed edge of the knife held in the knife assembly becomes the chip cutting edge earlier described and illustrated at E2 in FIG. 1.

Another knife mounting assembly, 160 is provided for the mounting of a double-edged knife on upstanding portion 50 of the holder.

More specifically, this upstanding portion has a flat surface 162 providing support for the flat side of a knife support 164. The knife support is secured to portion 50 with fasteners 166 extending through slots in the knife support with a construction similar to that discussed in connection with fasteners 74. Positioning the knife support is an abutment screw, like screw 82, adjustably positioned in threaded bore 168 extending through a shoulder 170. The knife support has a forward edge 172, a channel 174 spaced rearwardly of the forward edge, and a shallow ridge 176 between the channel and the forward edge.

A double-edged knife 178 rests on the knife support. The knife has a construction similar to the one described in connection with knife 62. The knife is positioned with its internal channel 180 fitting over ridge 176.

Knife mounting assembly 160 further includes a knife clamp 190. The knife clamp has a rock shoulder 192 (similar to rock shoulder 124) received within a complementing groove 194 in the knife support.

In the construction described, the two knife mounting assemblies 60, 160 support two double-edged knives end-to-end, with exposed edges of the two knives facing in the same direction and extending as an obtuse angle with respect to each other.

An edge may be renewed or replaced by turning knife 78 end-to-end, or by replacing the knife with a new knife similarly constructed. As in the case of first described knife 62, removal of the knife clamp and replacement of the knife edge has no effect on the position of the knife support in the knife mounting assembly, namely knife support 164. Where a new edge is provided by turning the knife element on itself, there is no requirement that adjustments in the machines be made to accommodate the new edge.

The edge provided by the knife in knife mounting assembly 160 is the planing edge in the machine, as exemplified by edge E1 earlier discussed.

The construction contemplated provides a number of advantages over prior known constructions, including the reducing of maintenance costs and reducing of downtime in the woodworking machine when replacement is required.

While a particular embodiment of the invention has been described, obviously variations and modifications are possible without departing from the invention.

It is claimed and desired to secure by letters patent:

1. A woodworking knife and holder combination comprising:

a holder;

a knife support with a forward edge and a rear portion supported on the holder in a position with said forward edge protruding beyond the holder;

adjustable mechanism providing support for said rear portion of the knife support and adjustable to change the protrusion of the forward edge of the knife support;

a double-edged knife supported on the knife support with one of the edges of the knife protruding beyond the forward edge of the knife support;

a clamp clamping against the knife with the knife sandwiched between the clamp and knife support; and fasteners detachably securing the knife support and clamp to the holder with the clamp clamping the knife against the knife support.

2. A woodworking knife and holder combination comprising:

a holder;

first and second double-edged knives disposed with the end of one adjacent the end of the other and with one edge of the first knife facing in the same direction as one edge of the second knife;

a first knife mounting assembly comprising a first knife support and a first knife clamp mounting the first knife on the holder with the knife clamped therebetween and a second assembly comprising a second knife support and a second knife clamp mounting the second knife on the holder with the second knife clamped therebetween;

a first adjustable mechanism adjustable to advance the first knife mounting assembly along a first path; and a second adjustable mechanism adjustable to advance the second knife mounting assembly along a second path, said second path extending along side the first path.

3. The combination of claim 2, wherein the holder has a first guide surface defining said first path and a second guide surface defining said second path, and said first and second adjustable mechanisms each include a stop which is adjustable and which engages a knife support to define a position for the knife support.

4. The combination of claim 2, which further includes means for securing the first knife support to said holder independently of the first knife clamp, and means for securing the second knife support to said holder independently of the second knife clamp.

5. The combination of claim 2, wherein said holder has a first substantially planar guide surface guiding the first knife support for movement along said first path, and said holder further has a second substantially planar guide surface guiding said second knife support for movement along said second path.

6. In a log slabbing chipper, the improvement comprising:

a log supporting means having a station occupied by a log beam processed;

a power-driven rotor head disposed adjacent and to one side of said station;

the rotor head and log supporting means being relatively movable in a direction paralleling the axis of a log held by the log supporting means; and knife structure on the rotor head including a first double-edged knife mounted on the rotor head moveable with movement of the rotor head in a conical cutting path, and a second double-edged knife mounted on the rotor head moveable with movement of the rotor head in a planar cutting path.

7. The log slabbing chipper of claim 6, further comprising:

a first knife mounting assembly mounting the first knife on the rotor head comprising a first knife support and a first knife clamp positioned with the first knife sandwiched therebetween and a second knife mounting assembly mounting the second knife on the rotor head comprising a second knife support and a second knife clamp disposed with the second knife sandwiched therebetween.

8. The log slabbing chipper of claim 7, wherein the knife structure includes a holder mounted on the rotor head, and the holder has first and second guide surfaces, and wherein said first knife mounting assembly is slidably supported on said first guide surface and said second knife mounting assembly is slidably supported on said second guide surface.

9. The log slabbing chipper of claim 8, wherein the knife structure further includes an adjustable abutment positioning said first knife mounting assembly on the holder, and another adjustable abutment positioning the second knife mounting assembly on the holder.

* * * * *

US005271442B1

REEXAMINATION CERTIFICATE (2873rd)

United States Patent [19] [11] B1 5,271,442

Carpenter et al. [45] Certificate Issued May 7, 1996

[54] KNIFE WITH CLAMP PACKAGE MOUNTING KNIFE

[75] Inventors: Charles T. Carpenter; Robert M. Bayly, both of Lake Oswego, Oreg.

[73] Assignee: Commercial Knife, Inc., Wilsonville, Oreg.

Reexamination Request:
No. 90/003,769, Mar. 27, 1995

Reexamination Certificate for:

| | |
|---|---|
| Patent No.: | **5,271,442** |
| Issued: | **Dec. 21, 1993** |
| Appl. No.: | **19,586** |
| Filed: | **Feb. 19, 1993** |

[51] Int. Cl.[6] ..... B27G 13/04

[52] U.S. Cl. ..... 144/220; 83/698; 144/162 R; 144/218; 144/241; 241/92; 241/292.1; 241/298; 407/37; 407/40; 407/87; 407/95

[58] Field of Search ..... 83/698; 144/162 R, 144/172, 174, 176, 218, 219, 220, 224, 228, 229, 230, 225, 221, 231, 241; 407/40, 41, 37, 85, 87, 94, 95, 108; 241/91, 92, 189.1, 292.1, 278, 298

[56] References Cited

PUBLICATIONS

Filer and Stowell brochure, "Model CHS Headrig Chipper", Apr. 1971.

*Primary Examiner*—W. Donald Bray

[57] ABSTRACT

A log slabbing chipper with multiple knife structures distributed about the periphery of a power-driven rotor head. Each knife structure includes a holder, and a pair of knife mounting assemblies secured to the holder. Each knife mounting assembly mounts a double-edged replaceable knife.

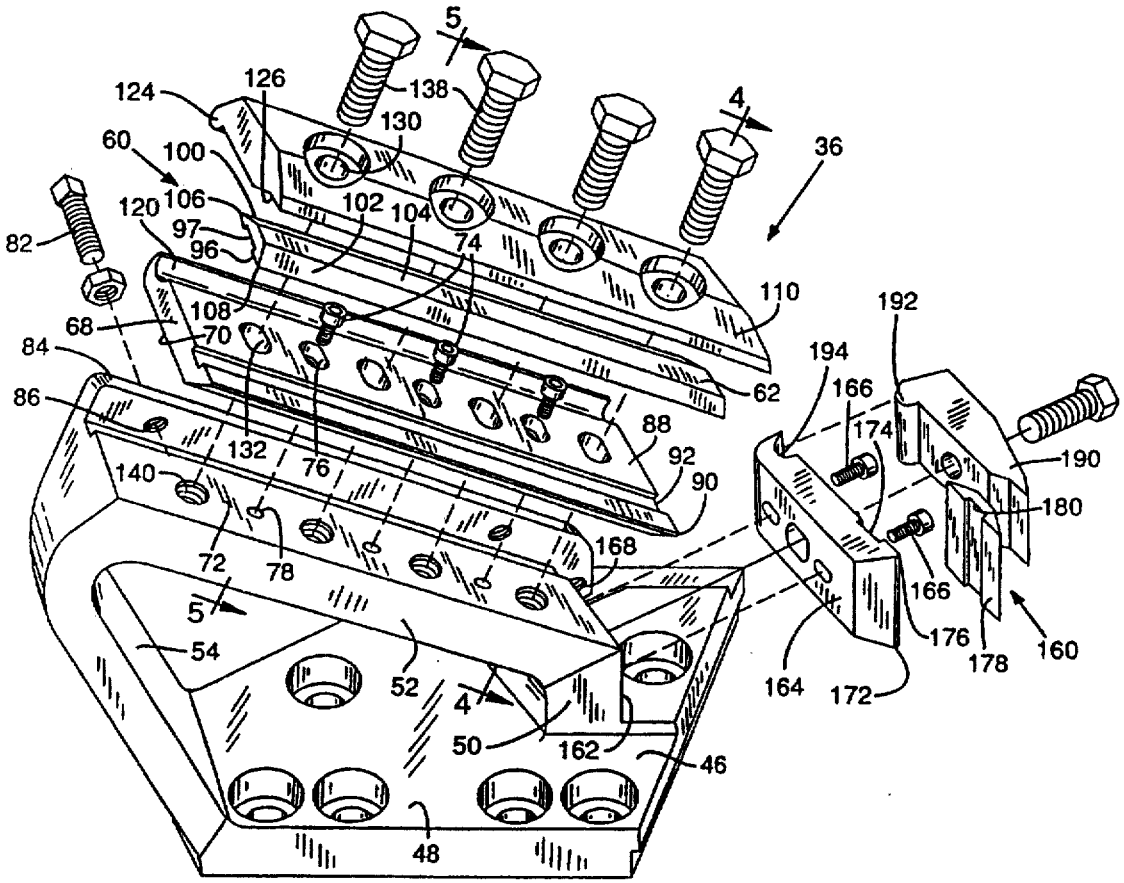

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–5 is confirmed.

Claims 6, 7 and 9 are determined to be patentable as amended.

Claim 8, dependent on an amended claim, is determined to be patentable.

6. In a log slabbing chipper, the improvement comprising:

a log supporting means having a station occupied by a log [beam] *being* processed;

a power-driven rotor head disposed adjacent and to one side of said station;

the rotor head and log supporting means being relatively moveably in a direction paralleling the axis of a log held by the log supporting means; [and]

knife structure on the rotor head including a first double-edged knife mounted on the rotor head moveable with movement of the rotor head in a conical cutting path, and a second double-edged knife mounted on the rotor head moveable with movement of the rotor head in a planar cutting path*; and*

*mounting structure for said knives which includes for each knife a locking portion which fits against a side of the knife and is locked thereto for movement together with the knife and an adjuster for changing the position of the locking portion.*

7. The log slabbing chipper of claim 6, [further comprising] *where the mounting structure comprises*:

a first knife mounting assembly mounting the first knife on the rotor head comprising a first knife support *which includes the locking portion associated with the knife* and a first knife clamp positioned with the first knife sandwiched [therebetween] *between the knife support and knife clamp,* and a second knife mounting assembly mounting the second knife on the rotor head comprising a second knife suppport *which includes the locking portion associated with the knife* and a second knife clamp disposed with the second knife sandwiched [therebetween] *between the second knife support and second knife clamp.*

9. The log slabbing chipper of claim 8, wherein the [knife structure further includes] *adjuster comprises* an adjustable abutment *for* positioning [said first] *a* knife mounting assembly on the holder[, and another adjustable abutment positioning the second knife mounting assembly on the holder].

* * * * *